US010602813B2

(12) United States Patent
Yang et al.

(10) Patent No.: US 10,602,813 B2
(45) Date of Patent: Mar. 31, 2020

(54) LATCHING MECHANISM AND WEARABLE DEVICE

(71) Applicant: ZTE Corporation, Shenzhen, Guangdong Province (CN)

(72) Inventors: Xiao Yang, Shenzhen (CN); Ling Wu, Shenzhen (CN); Bin Gao, Shenzhen (CN)

(73) Assignee: ZTE CORPORATION (CN)

( * ) Notice: Subject to any disclaimer, the term of this patent is extended or adjusted under 35 U.S.C. 154(b) by 84 days.

(21) Appl. No.: 15/735,581

(22) PCT Filed: Aug. 4, 2015

(86) PCT No.: PCT/CN2015/086062

§ 371 (c)(1),
(2) Date: Dec. 11, 2017

(87) PCT Pub. No.: WO2016/201773

PCT Pub. Date: Dec. 22, 2016

(65) Prior Publication Data

US 2018/0295950 A1 Oct. 18, 2018

(30) Foreign Application Priority Data

Jun. 15, 2015 (CN) ..... 2015 1 0330107

(51) Int. Cl.
*A44C 5/14* (2006.01)
*G04B 37/14* (2006.01)

(52) U.S. Cl.
CPC ..... *A44C 5/14* (2013.01); *G04B 37/1486* (2013.01)

(58) Field of Classification Search
CPC ..... A44C 5/14; A44C 5/147; G04B 37/14; G04B 37/1486
See application file for complete search history.

(56) References Cited

U.S. PATENT DOCUMENTS 257,636 A * 5/1882 Atkins ..... A44B 11/2549 24/630
1,790,706 A 2/1931 Hill
(Continued)

FOREIGN PATENT DOCUMENTS

CN 2251911 Y 4/1997
CN 1304292 A 7/2001
(Continued)

OTHER PUBLICATIONS

Office Action dated Dec. 4, 2017, Chinese Patent Application No. 201510330107.7.

*Primary Examiner* — Daniel P Wicklund
(74) *Attorney, Agent, or Firm* — McDonald Hopkins LLC

(57) ABSTRACT

Provided are a latching mechanism and a wearable device including the latching mechanism. The latching mechanism includes: a latching housing (1), including an elastic member mounting hole (2) through which an elastic member (3) penetrates and from which two ends of the elastic member extend; two push rods (4), oppositely abutting against two ends of the elastic member and connected to the latching housing in a slide fit, each push rod including a clamping post (5) protruding in a direction away from the latching housing, and the clamping posts of push rods being located in same axis and parallel with an axial direction of the elastic member; and a packaging housing (6), packaging and covering the latching housing and push rods in a direction perpendicular to the axial direction of the elastic member, exposing side surfaces (7), perpendicular to the axial direction of the elastic member, of the push rods.

15 Claims, 5 Drawing Sheets

(56) References Cited

U.S. PATENT DOCUMENTS

| | | | | | |
|---|---|---|---|---|---|
| 2,652,612 | A | | 9/1953 | Valcourt | |
| 2,870,511 | A | * | 1/1959 | Sand | A44C 5/14 24/265 B |
| 4,675,955 | A | * | 6/1987 | Nakamura | A44B 11/266 24/265 WS |
| 5,305,503 | A | * | 4/1994 | Yamagata | A44C 5/24 24/265 WS |
| 5,305,617 | A | * | 4/1994 | Fontana | A44C 5/2042 24/265 WS |
| 5,485,659 | A | * | 1/1996 | Kashikie | A44C 5/2052 24/265 WS |
| 9,498,029 | B2 | * | 11/2016 | Schooley | A44C 5/2057 |
| 2007/0070823 | A1 | * | 3/2007 | Sima | A44C 5/14 368/282 |
| 2007/0113534 | A1 | * | 5/2007 | So | A44C 5/102 59/82 |
| 2007/0143970 | A1 | * | 6/2007 | Loetscher | A44C 5/14 24/265 B |
| 2011/0197400 | A1 | | 8/2011 | Hartzband | |
| 2014/0150495 | A1 | * | 6/2014 | Kaltenrieder | A44C 5/14 63/3.2 |

FOREIGN PATENT DOCUMENTS

| | | | |
|---|---|---|---|
| CN | 201278879 | Y | 7/2009 |
| CN | 203407616 | U | 1/2014 |
| DE | 19729903 | A1 | 1/1999 |
| EP | 1980171 | A1 | 10/2008 |
| JP | 2006-034654 | A | 2/2006 |
| JP | 2006-271812 | A | 10/2006 |

* cited by examiner

LATCHING MECHANISM AND WEARABLE DEVICE

TECHNICAL FIELD

The present application relates to, but not limited to, the technical field of wearable devices.

BACKGROUND

A latch of a wearable smart device such as a smart wristwatch and a smart bracelet in the related art is assembled onto a watchband via a spring bar. The assembly process is as follows. One end of the spring bar is inserted into a fixing hole of a watch frame, and the end of the spring bar is pressed by using tweezers to slowly approach another fixing hole of the watch frame, and then the end of the spring bar is inserted into the fixing hole of the watch frame under the action of a spring after loosening the tweezers. However, due to over-pressure during assembly, the elasticity of the spring bar may be influenced, and the reliability of the spring bar may be reduced. In addition, the fixing hole of the watch frame is not easily aligned during assembly, thereby resulting in assembly inflexibility. Moreover, the space of the spring bar after assembly is small, and if the force of the spring is small, the spring bar may be disengaged from the fixing hole of the watch frame. That is to say, the structural form of a conventional latch has the problems of poor reliability, inflexible assembly and disassembly, and the like.

SUMMARY

The following is a brief introduction for a subject described herein in detail. The brief introduction is not intended to restrict the scope of protection of claims.

The present disclosure provides a latching mechanism and a wearable device, to solve the problems of poor reliability and inflexible assembly and disassembly in the related art.

A latching mechanism, applied to a watchband, includes:

a latching housing, including an elastic member mounting hole through which an elastic member penetrates and from which two ends of the elastic member extend;

two push rods, oppositely abutting against the two ends of the elastic member, each push rod being connected to the latching housing in a slide fit and being capable of sliding relative to the latching housing in an axial direction of the elastic member, each push rod including a clamping post protruding in a direction away from the latching housing, and the clamping posts of the two push rods being located in the same axis and parallel with the axial direction of the elastic member; and a packaging housing, packaging and covering the latching housing and the two push rods in a direction perpendicular to the axial direction of the elastic member, and being fixedly connected to the latching housing and slidably connected relative to the two push rods, and exposing side surfaces, perpendicular to the axial direction of the elastic member, of the push rods, such that the push rods can be pushed to slide relative to the latching housing via the exposed side surfaces.

In an exemplary embodiment, a limiting hole is provided on the latching housing, and a limiting post is arranged on the push rod, and the limiting hole and the limiting post are located in the same axis and parallel with the axial direction of the elastic member, and the limiting post is inserted into the limiting hole, and the push rod slidably fits with the latching housing by means of sliding of the limiting posts in the limiting hole.

In an exemplary embodiment, there are two limiting holes, and there are two limiting posts on each push rod, and the limiting holes are through-holes penetrating through the latching housing, and the elastic member mounting hole is located between the two limiting holes.

In an exemplary embodiment, a matching post is arranged on a side surface contacting with the elastic member, of each push rod, and the matching post is inserted into the elastic member from one end of the elastic member.

In an exemplary embodiment, each of two sides of the latching housing is provided with a groove separately, and the push rods are arranged in the grooves, and the grooves and the push rods are adapted in shape.

In an exemplary embodiment, the elastic member is a spring.

In an exemplary embodiment, a first connecting structure is arranged on the latching housing, a second connecting structure is arranged on the packaging housing, a shifting hole is provided on a push rod, and the packaging housing is fixedly connected to the first connecting structure by the second connecting structure penetrating through the shifting hole, to fixedly connected to the latching housing, and is slidably connected relative to the two push rods.

In an exemplary embodiment, the first connecting structure is formed as a clamping hole, the second connecting structure is formed as a buckle or a clamping pin, and the second connecting structure penetrates through the shifting hole and engages with the first connecting structure.

In an exemplary embodiment, a first connecting hole is provided on the latching housing, a second connecting hole is provided on the packaging housing, and the first connecting hole and the second connecting hole are connected in a screw fit.

In an exemplary embodiment, each of two sides of the packaging housing is provided with a recess portion separately, and a recessing direction of the recess portions is consistent with an extending direction of the second connecting structure.

In an exemplary embodiment, a positioning block is arranged on the latching housing, and a positioning hole is provided on the packaging housing, and the positioning block is inserted into the positioning hole.

In an exemplary embodiment, a first mounting hole is provided on the latching housing, a second mounting hole is provided at a corresponding position on the packaging housing, the latching housing is mounted on the watchband via the first mounting hole, and the packaging housing is mounted on the watchband via the second mounting hole.

In an exemplary embodiment, two side edges of an end, away from the clamping post, of the latching housing are formed as stepped structures.

In an exemplary embodiment, the middle of the end, having the two side edges formed as the stepped structures, is provided with a first positioning slot, a corresponding position on the packaging housing is provided with a second positioning slot, the latching housing is positioned by an insertion connection between the first positioning slot and a positioning post on the watchband, and the packaging housing is positioned by an insertion connection between the second positioning slot and the positioning post.

A wearable device includes the above-mentioned latching mechanism.

In an exemplary embodiment, the wearable device further includes a watch frame and a watchband. A fixing hole is provided on the watch frame, and a receiving space is provided inside the watchband, and a recess matching portion is arranged on one side of the watchband, and the recess matching portion is internally provided with a third mounting hole penetrating into the receiving space.

The latching mechanism is arranged in the receiving space and adapted with the third mounting hole via a screw. The latching mechanism is fixedly connected to the watchband and inserted into the fixing hole via a clamping post, and the latching mechanism is in a rotatable manner connected to the watch frame.

In an exemplary embodiment, the wearable device further includes a paster, which is pasted into the recess matching portion.

In the above-mentioned solution, the latching mechanism is provided with a latching housing and a packaging housing to form a closed space, and push rods are arranged in the closed space, and clamping posts of the push rods and a side surface of each push rod are exposed, such that the push rods can be pushed to slide via the exposed side surfaces, and thereby the clamping posts are inserted into fixing holes of a watch frame, and assembly between a watchband (a buckle mechanism is fixed into the watchband) and the watch frame is finally completed. This structural form provided in embodiments of the present disclosure is easy to assemble and disassemble, simple in assembly and good in reliability.

After the drawings and the detailed descriptions are read and understood, other aspects can be understood.

DETAILED DESCRIPTION

Figure 1:
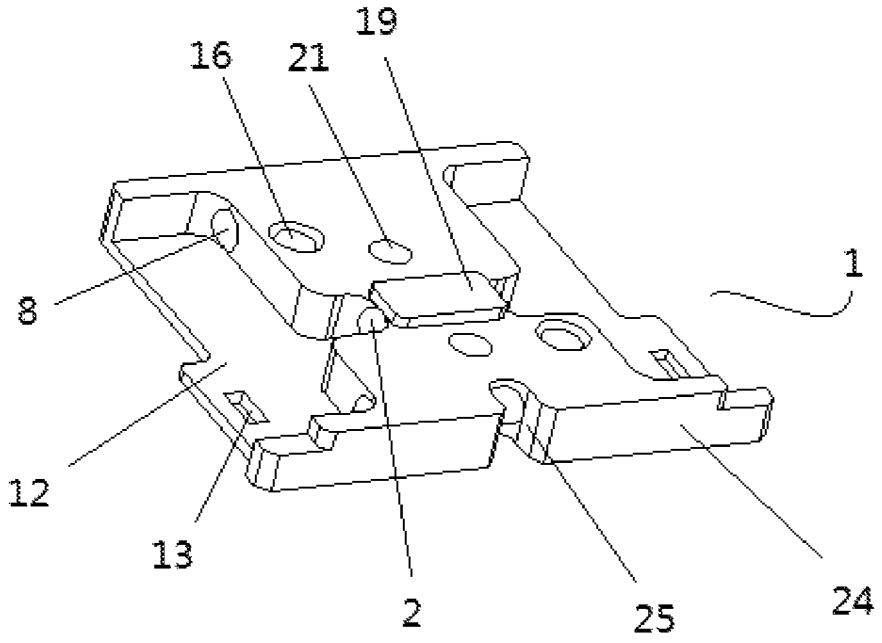
FIG. 1 is a structure diagram of a latching housing in an embodiment one of the present disclosure.

Embodiments of the present disclosure will be described in detail hereinbelow in conjunction with the drawings.

As for the problems in the related art that a structural mode of a latch is poor in reliability and inflexible to assemble and disassemble, Embodiments of the present disclosure provide multiple solutions as follows.

Embodiment One

A latching mechanism in the embodiment one of the present disclosure is applied to a watchband. As shown in FIG. 1 to FIG. 4 and FIG. 6, the latching mechanism includes a latching housing 1, two push rods 4 and a packaging housing 6.

The latching housing 1 includes an elastic member mounting hole 2, and an elastic member 3 penetrates through the elastic member mounting hole 2, and two ends of the elastic member 3 extend from the elastic member mounting hole 2.

The two push rods 4 oppositely abut against the two ends of the elastic member 3. Each push rod 4 is connected to the latching housing 1 in a slide fit, and is capable of sliding relative to the latching housing 1 in an axial direction of the elastic member 3. Each push rod 4 includes a clamping post 5 protruding in a direction away from the latching housing 1, and the clamping posts 5 of the two push rods 4 are located in the same axis and parallel with the axial direction of the elastic member 3.

The packaging housing 6 packages and covers the latching housing 1 and the two push rods 4 in a direction perpendicular to the axial direction of the elastic member 3, and is fixedly connected to the latching housing 1 and slidably connected relative to the two push rods 4. The packaging housing 6 exposes side surfaces 7, perpendicular to the axial direction of the elastic member 3, of the push rods 4 such that the push rods 4 can be pushed to slide relative to the latching housing 1 via the exposed side surfaces 7.

The latching mechanism provided in the embodiment one of the present disclosure is provided with a latching housing and a packaging housing to form a closed space. Push rods are arranged in the closed space, and clamping posts of the push rods and a side surface of each push rod are exposed, such that the push rods can be pushed to slide via the exposed side surfaces, and thereby the clamping posts are inserted into fixing holes of a watch frame, and assembly between a watchband (a buckle mechanism is fixed into the watchband) and the watch frame is finally completed. This structural form provided in embodiments of the present disclosure is easy to assemble and disassemble, simple in assembly and good in reliability.

As shown in FIG. 1 and FIG. 3 to FIG. 5, a limiting hole 8 is provided on the latching housing 1, and a limiting post 9 is arranged on the push rod 4. And the limiting hole 8 and the limiting post 9 are located in the same axis and parallel with the axial direction of the elastic member 3, the limiting post 9 is inserted into the limiting hole 8. The push rod 4 slidably fit with the latching housing 1 by means of sliding of the limiting post 9 in the limiting hole 8.

Figure 3:
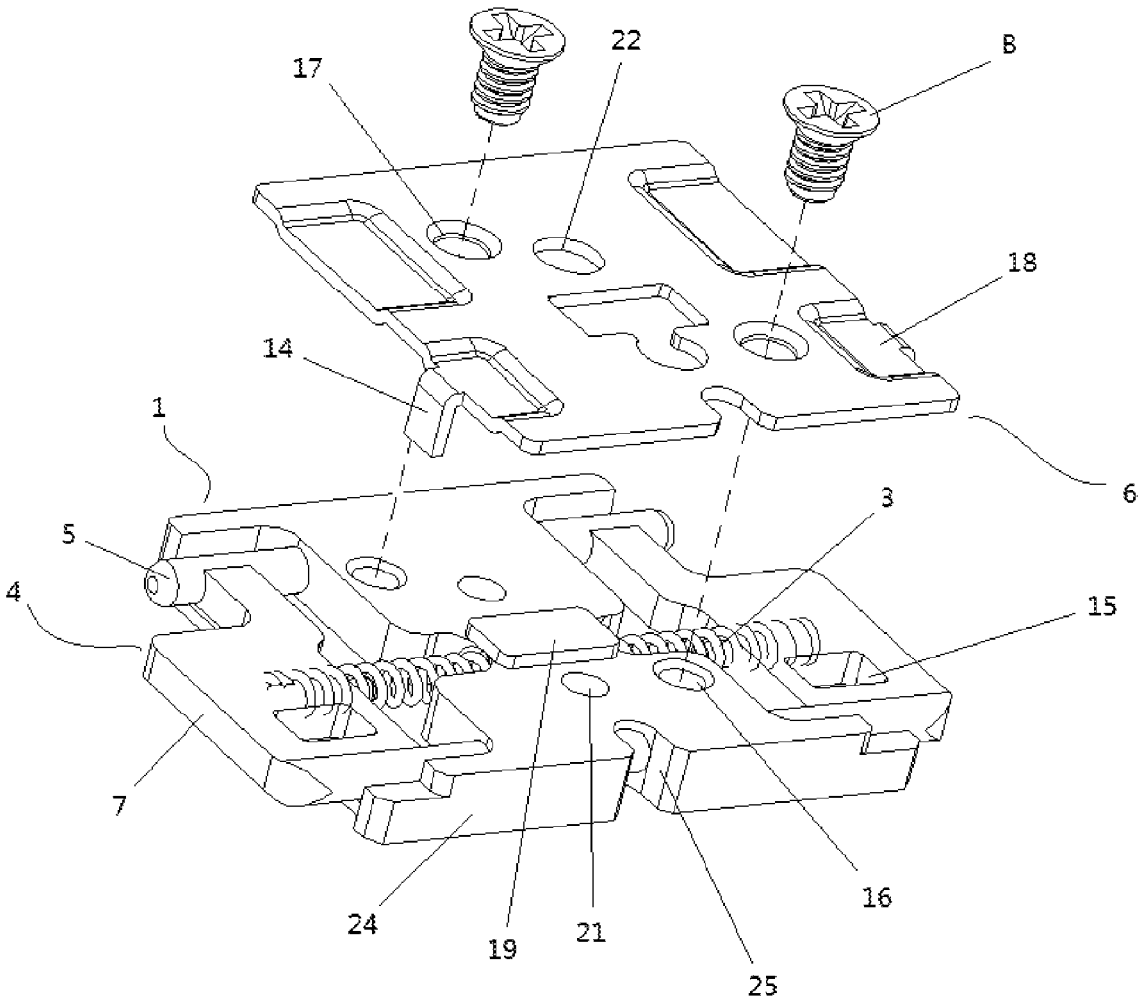
FIG. 3 is a structure diagram of a latching mechanism in the embodiment one of the present disclosure.
Figure 5:
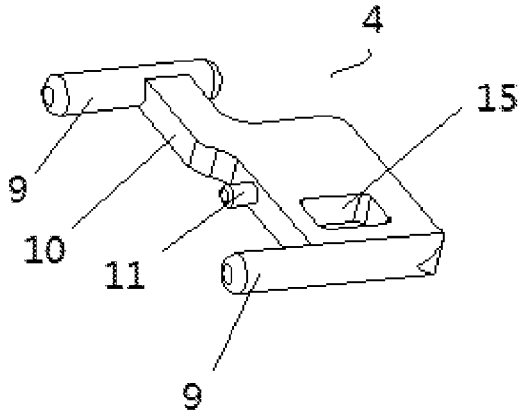
FIG. 5 is a structure diagram two of a push rod in the embodiment one of the present disclosure.

To simplify the process flow, as shown in FIG. 1, FIG. 3 and FIG. 5, in the embodiment one of the present disclosure, there are two limiting holes 8, there are two limiting posts 9 on each push rod 4. The limiting holes 8 are through-holes penetrating through the latching housing 1, and the elastic member mounting hole 2 is located between the two limiting holes 8.

Figure 4:
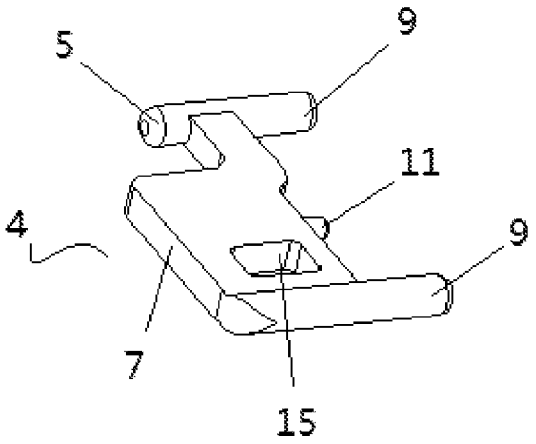
FIG. 4 is a structure diagram one of a push rod in the embodiment one of the present disclosure.

To make an elastic force, applied to the push rods by the elastic member, more accurate and effective, as shown in FIG. 3 to FIG. 5, a matching post 11 is arranged on a side surface 10 contacting with the elastic member 3, of each push rod 4. The matching post 11 is inserted into the elastic member 3 from one end of the elastic member.

As shown in FIG. 1 and FIG. 3, each of two sides of the latching housing 1 is provided with a groove 12 separately, and the push rods 4 are arranged in the grooves 12, and the grooves 12 and the push rods 4 are adapted in shape.

Figure 2:
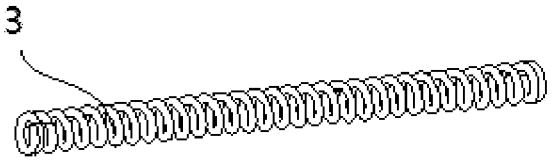
FIG. 2 is a structure diagram of an elastic member in the embodiment one of the present disclosure.

As shown in FIG. 2, the elastic member 3 may be a spring optionally.

As shown in FIG. 1, FIG. 3 to FIG. 6, a first connecting structure 13 is arranged on the latching housing 1, and a second connecting structure 14 is arranged on the packaging housing 6, and a shifting hole 15 is provided on the push rod 4. The packaging housing 6 is fixedly connected to the latching housing 1 in a manner that the second connecting structure 14 penetrates through the shifting hole 15 and is fixedly connected to the first connecting structure 13, and the packaging housing 6 is slidably connected relative to the two push rods 14.

As shown in FIG. 1 and FIG. 3, the first connecting structure 13 is formed as a clamping hole, and the second connecting structure 14 is formed as a buckle or a clamping pin, and the second connecting structure 14 penetrates through the shifting hole 15 and engages with the first connecting structure 13.

Figure 6:
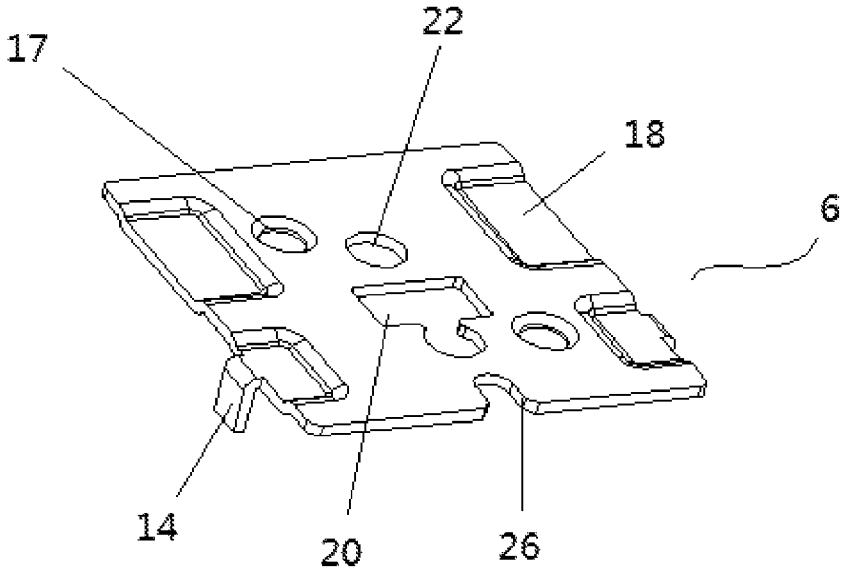
FIG. 6 is a structure diagram of a packaging housing in the embodiment one of the present disclosure.
Figure 7:
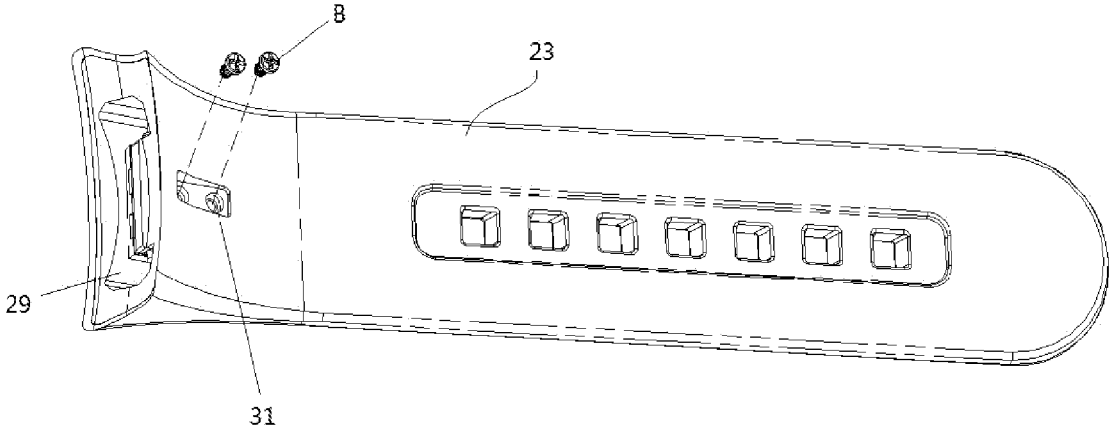
FIG. 7 is a diagram one of adapting between a latching mechanism and a watchband in an embodiment two of the present disclosure.

To more firmly fix the latching housing and the packaging housing, as shown in FIG. 1, FIG. 3 and FIG. 6, a first connecting hole 16 is provided on the latching housing 1, and a second connecting hole 17 is provided on the packaging housing 6, and the first connecting hole 16 and the second connecting hole 17 are connected in a screw fit via a screw B.

To enhance a close fit between the packaging housing and the latching housing as well as the push rods, and to reduce gaps therebetween, and to improve the accuracy of movement, as shown in FIG. 3 and FIG. 6, each of two sides of the packaging housing 6 is provided with a recess portion 18 separately, and a recessing direction of the recess portions 18 is consistent with an extending direction of the second connecting structure 14.

To improve the assembly speed and accuracy, as shown in FIG. 1, FIG. 3 and FIG. 6, a positioning block 19 is arranged on the latching housing 1, and a positioning hole 20 is provided on the packaging housing 6, and the positioning block 19 is inserted into the positioning hole 20.

As shown in FIG. 1, FIG. 3, FIG. 6 and FIG. 7, a first mounting hole 21 is provided on the latching housing 1, and a second mounting hole 22 is provided at a corresponding position on the packaging housing 6. The latching housing 1 is mounted on the watchband 23 via the first mounting hole 21, and the packaging housing 6 is mounted on the watchband 23 via the second mounting hole 22.

To be better adapted with the watchband, as shown in FIG. 1 and FIG. 3, two side edges of an end 24, away from the clamping post 5, of the latching housing 1 are formed as stepped structures.

To be quickly mounted on the watchband, as shown in FIG. 1, FIG. 3, FIG. 6 and FIG. 7, the middle of the end 24, having the two side edges formed as the stepped structures, is provided with a first positioning slot 25, and a corresponding position on the packaging housing 6 is provided with a second positioning slot 26. The latching housing 1 is positioned by an insertion connection between the first positioning slot 25 and a positioning post on the watchband 23. The packaging housing 6 is positioned by an insertion connection between the second positioning slot 26 and the positioning post.

The functions of the latching mechanism in the embodiment one of the present disclosure can be realized by improving a wearable device in the related art.

Embodiment Two

Figure 8:
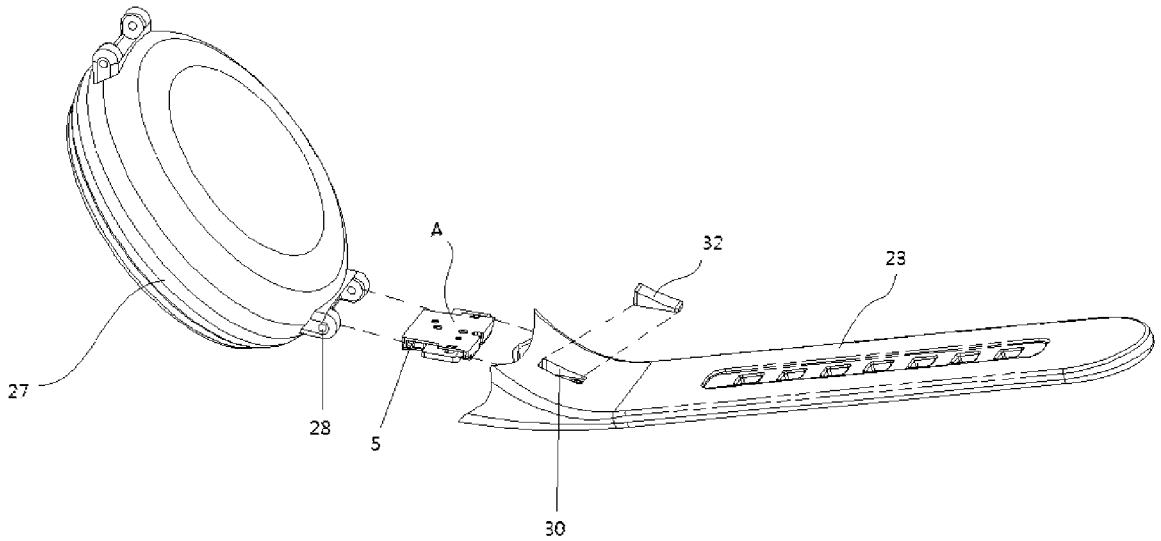
FIG. 8 is a structure diagram of part of a wearable device in the embodiment two of the present disclosure.

As shown in FIG. 8, a wearable device in the embodiment two of the present disclosure includes the above-mentioned latching mechanism A.

As shown in FIG. 7, FIG. 8, FIG. 10 and FIG. 11, the wearable device further includes a watch frame 27 and a watchband 23. Herein, a fixing hole 28 is provided on the watch frame 27, and a receiving space 29 is provided inside the watchband 23, and a recess matching portion 30 is arranged on one side of the watchband 23. The recess matching portion 30 is internally provided with a third mounting hole 31 penetrating into the receiving space 29.

The latching mechanism A is arranged inside the receiving space 29 and adapted with the third mounting hole 31 via a screw B. The latching mechanism A is fixedly connected to the watchband 23 and inserted into the fixing hole 28 via a clamping post 5. The latching mechanism A is in a rotatable manner connected to the watch frame 27.

Herein, a positioning post is arranged in the receiving space, and the latching mechanism provides a first positioning slot and a second positioning slot for insertion fit with the positioning post for positioning.

Figure 9:
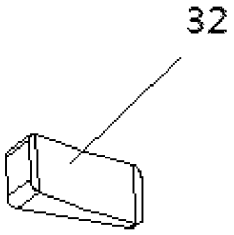
FIG. 9 is a structure diagram of a paster in the embodiment two of the present disclosure.
Figure 10:
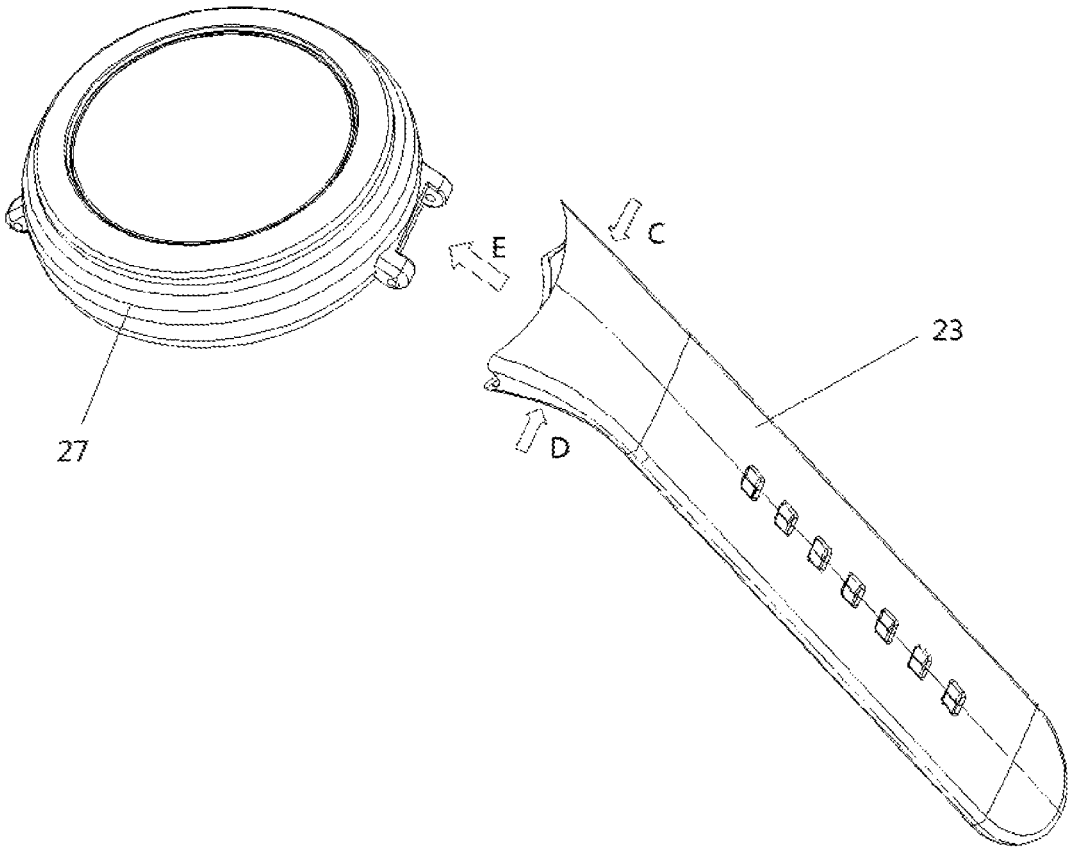
FIG. 10 is a diagram of assembly between a watchband and a watch frame in the embodiment two of the present disclosure.
Figure 11:
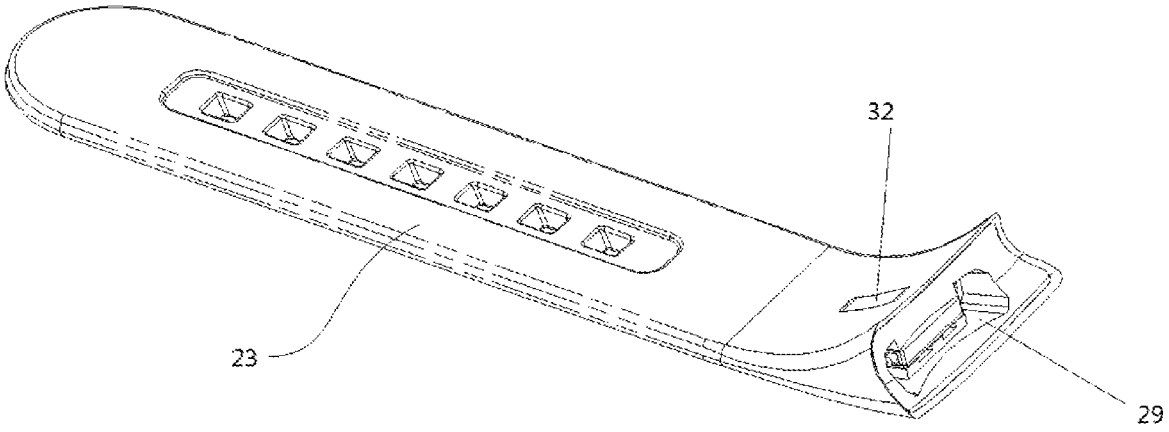
FIG. 11 is a diagram two of adapting between a latching mechanism and a watchband in the embodiment two of the present disclosure.

To ensure the safety of a user and the attractiveness and durability of the wearable device, as shown in FIG. 8, FIG. 9 and FIG. 11, the wearable device further includes a paster 32. The paster 32 is pasted into the recess matching portion 30.

The paster in the embodiment two of the present disclosure may be made of silica gel optionally, and the watchband may be made of soft rubber optionally.

It is important to note that the implementation embodiments of the above-mentioned latching mechanism are applicable to embodiments of the wearable device, and can achieve the same technical effect.

The wearable device provided in the embodiment two of the present disclosure will be illustrated hereinbelow.

As shown in FIG. 1 to FIG. 11, the wearable device includes: a latching mechanism A, a watchband 23, a silica gel paster 32 and a watch frame 27. The latching mechanism A includes: a latching housing 1, a spring 3, push rods 4 (each push rod 4 is provided with a push rod button-side surface 7 and a limiting post 9), a packaging housing 6 and a screw B.

Firstly, the spring 3 is assembled in an elastic member mounting hole 2 of the latching housing 1. The spring 3 is located at a middle position of the latching housing 1. Then, the push rods 4 are assembled in limiting holes 8. Each push rod 4 is assembled on one of left and right sides, and the push rods 4 on the two sides are pressed. Then, the packaging housing 6 is clamped to the latching housing 1, and then the screw B is locked to the packaging housing 6 to fix the whole latching mechanism A. Finally the latching mechanism A is assembled completely. The latching mechanism A is inserted into the watchband 23, and the latching mechanism A is fixed to the watchband 23 via the screw B. Herein, screw holes (a first mounting hole 21 and a second mounting hole 22) of the latching mechanism A are aligned with a third mounting hole 31 of the watchband 23, then the screw B is locked for fixing, and the silica gel paster 32 covers the screw B. The two push rods 4 of the latching mechanism A are pressed by using fingers in a direction C and a direction D to allow the watchband 23 to approach the watch frame 27 in a direction E. Then the fingers are loosened, the watchband 23 is clamped to the watch frame 27, and the limiting posts 9 of the push rods 4 are inserted into fixing holes 28 of the watch frame 27. Therefore the watchband 23 is fixed to the watch frame 27.

There may be one or more springs in the embodiments of the present disclosure. The assembly between the packaging housing and the locking housing may be fixed via a clamping pin and a screw or may be fixed via a buckle.

INDUSTRIAL APPLICABILITY

The latching mechanism provided in the embodiments of the present disclosure is simple in assembly, good in reliability and easy to maintain. Moreover, a mechanism form is novel, and the mass production is excellent. The problems in the related art that a structural mode of a latch is poor in reliability and inflexible to assemble and disassemble are solved.

What we claim is:

1. A latching mechanism, applied to a watchband, comprising:

a latching housing, comprising an elastic member mounting hole through which an elastic member penetrates and from which two ends of the elastic member extend;

two push rods, oppositely abutting against the two ends of the elastic member, each push rod being connected to the latching housing in a slide fit and being capable of sliding relative to the latching housing in an axial direction of the elastic member, each push rod comprising a clamping post protruding in a direction away from the latching housing, and the clamping posts of the two push rods being located in the same axis and parallel with the axial direction of the elastic member; and a packaging housing, packaging and covering the latching housing and the two push rods in a direction perpendicular to the axial direction of the elastic member, and being fixedly connected to the latching housing and slidably connected relative to the two push rods, and exposing side surfaces, perpendicular to the axial direction of the elastic member, of the two push rods, such that the push rods can be pushed to slide relative to the latching housing via the exposed side surfaces.

2. The latching mechanism according to claim 1, wherein at least one limiting hole is provided on the latching housing, and at least one limiting post is arranged on each push rod, and the limiting hole and the limiting post are located in the same axis and parallel with the axial direction of the elastic member, and the limiting post is inserted into the limiting hole, and each push rod slidably fits with the latching housing by means of sliding of the limiting post in the limiting hole.

3. The latching mechanism according to claim 2, wherein there are two limiting holes, and there are two limiting posts on each push rod, and the limiting holes are through-holes penetrating through the latching housing, and the elastic member mounting hole is located between the two limiting holes.

4. The latching mechanism according to claim 1, wherein a matching post is arranged on a side surface contacting with the elastic member, of each push rod, and the matching post is inserted into the elastic member from one end of the elastic member.

5. The latching mechanism according to claim 1, wherein each of two sides of the latching housing is provided with a groove separately, and the push rods are arranged in the grooves, and the grooves and the push rods are adapted in shape.

6. The latching mechanism according to claim 1, wherein the elastic member is a spring.

7. The latching mechanism according to claim 1, wherein a first connecting structure is arranged on the latching housing, a second connecting structure is arranged on the packaging housing, a shifting hole is provided on each push rod, and the packaging housing is fixedly connected to the first connecting structure by the second connecting structure penetrating through the shifting hole, to fixedly connected to the latching housing, and is slidably connected relative to the two push rods.

8. The latching mechanism according to claim 7, wherein the first connecting structure is formed as a clamping hole, the second connecting structure is formed as a buckle or a clamping pin, and the second connecting structure penetrates through the shifting hole and engages with the first connecting structure.

9. The latching mechanism according to claim 8, wherein a first connecting hole is provided on the latching housing, a second connecting hole is provided on the packaging housing, and the first connecting hole and the second connecting hole are connected in a screw fit; and/or a positioning block is arranged on the latching housing, a positioning hole is provided on the packaging housing, and the positioning block is inserted into the positioning hole.

10. The latching mechanism according to claim 7, wherein each of two sides of the packaging housing is provided with a recess portion separately, and a recessing direction of the recess portions is consistent with an extending direction of the second connecting structure.

11. The latching mechanism according to claim 1, wherein a first mounting hole is provided on the latching housing, a second mounting hole is provided at a corresponding position on the packaging housing, the latching housing is mounted on the watchband via the first mounting hole, and the packaging housing is mounted on the watchband via the second mounting hole.

12. The latching mechanism according to claim 1, wherein two side edges of an end, away from the clamping post, of the latching housing are formed as stepped structures; and the middle of the end, having the two side edges formed as the stepped structures, is provided with a first positioning slot, a corresponding position on the packaging housing is provided with a second positioning slot, the latching housing is positioned by an insertion connection between the first positioning slot and a positioning post on the watchband, and the packaging housing is positioned by an insertion connection between the second positioning slot and the positioning post.

13. A wearable device, comprising the latching mechanism according to claim 1.

14. The wearable device according to claim 13, further comprising: a watch frame and a watchband, wherein a fixing hole is provided on the watch frame, a receiving space is provided inside the watchband, a recess matching portion is arranged on one side of the watchband, and the recess matching portion is internally provided with a third mounting hole penetrating into the receiving space; and the latching mechanism is arranged in the receiving space and adapted with the third mounting hole via a screw, the latching mechanism is fixedly connected to the watchband and inserted into the fixing hole via at least one of the clamping posts, and the latching mechanism is in a rotatable manner connected to the watch frame.

15. The wearable device according to claim 14, further comprising: a paster, which is pasted into the recess matching portion.

* * * * *